US006044780A

United States Patent [19]

Kastrup et al.

[11] Patent Number: 6,044,780

[45] Date of Patent: Apr. 4, 2000

[54] EYELET-BUTTONHOLE SEWING MACHINE

[75] Inventors: Eberhard Kastrup, Bielefeld; Jochen Fischer, Detmold, both of Germany

[73] Assignee: Dürkopp Alder AG, Germany

[21] Appl. No.: 09/256,923

[22] Filed: Feb. 24, 1999

[30] Foreign Application Priority Data

Feb. 24, 1998 [DE] Germany ..... 198 07 772

[51] Int. Cl.[7] ..... D05B 3/08

[52] U.S. Cl. ..... 112/66; 112/68; 112/73

[58] Field of Search ..... 112/66, 65, 68, 112/70, 73, 447, 475.25

[56] References Cited

U.S. PATENT DOCUMENTS 1,991,627 2/1935 Reece .
5,873,314 2/1999 Gamano et al. ..... 112/73 X

FOREIGN PATENT DOCUMENTS 690654 4/1940 Germany .
4132586 4/1992 Germany .
19647330 5/1997 Germany .
19647393 5/1997 Germany .

*Primary Examiner*—Peter Nerbun
*Attorney, Agent, or Firm*—Ostrolenk, Faber, Gerb & Soffen, LLP

[57] ABSTRACT

A sewing machine has a table, driven in one plane and carrying the material to be sewn, a stitch-forming device and a cutting device for producing a buttonhole in the material to be sewn. The buttonhole is provided with an incision, is produced in the pre-cutting or post-cutting mode and is bounded by zigzag stitches, running around the incision, of a buttonhole bead. The sewing machine has sewing tools comprising a needle bar, which is driven up and down and oscillates in the horizontal direction, and a needle, which is provided at the bottom end of the needle bar and interacts with a looper mounted in a base plate. An adjusting device sets the position of the zigzag stitches being provided in order to provide intermediate material (b) within the buttonhole bead in the post-cutting mode for allowing the material to be cut, without cutting the already-formed buttonhole bead. The oscillating motion of the needle bar is controllable by a selective drive mechanism, the position of the zigzag stitches being changed in direct coupling with the rotary position of the sewing tools by shifting the drive mechanism.

22 Claims, 6 Drawing Sheets

Fig. 1
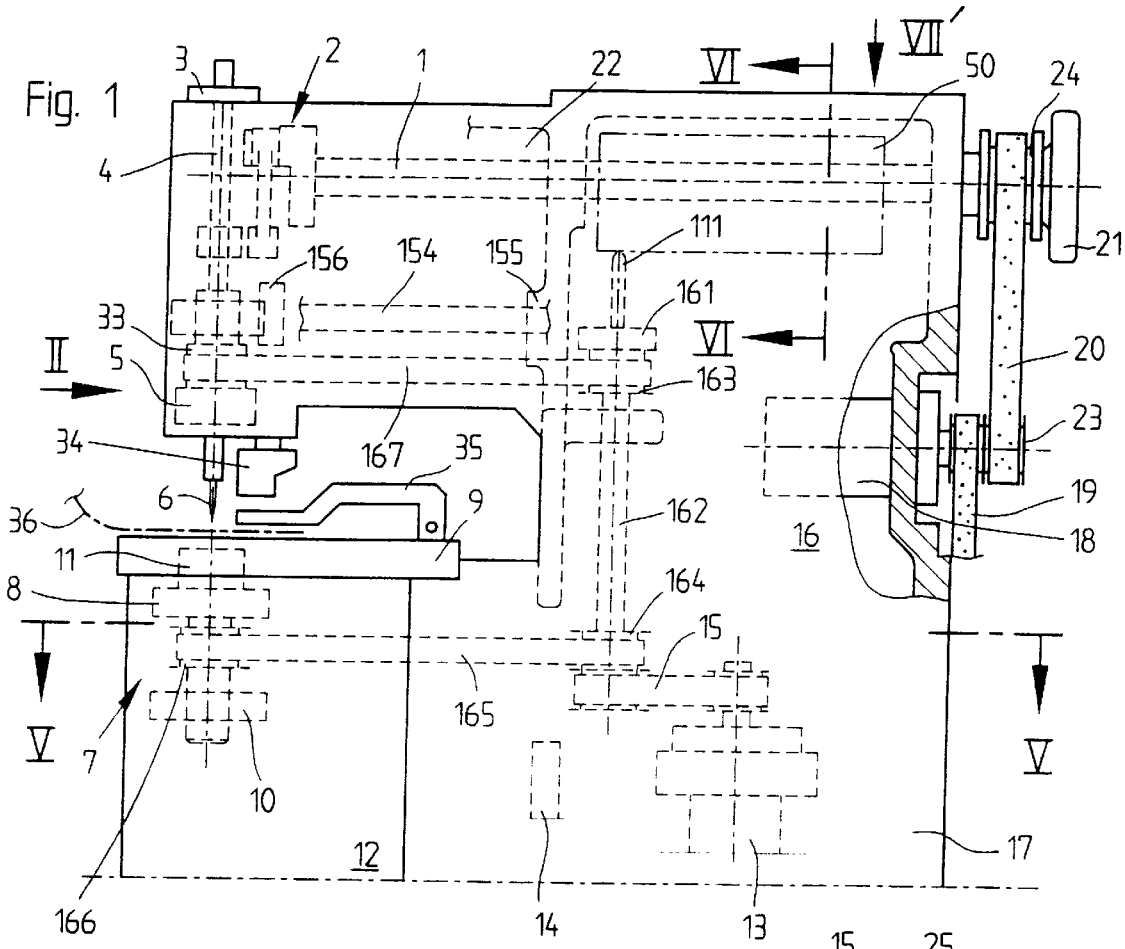
Fig. 5
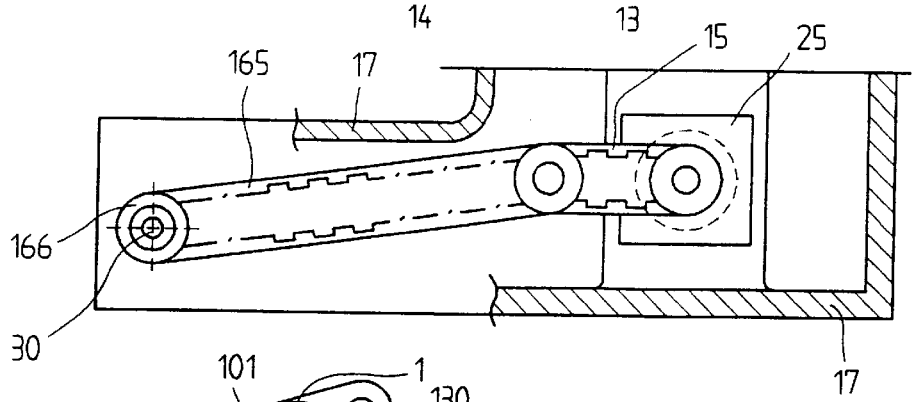
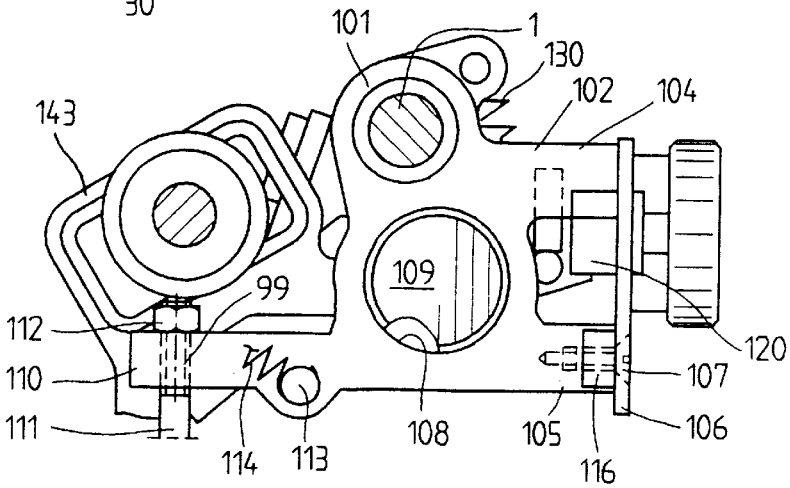
Fig. 13

EYELET-BUTTONHOLE SEWING MACHINE

CROSS-REFERENCE TO RELATED APPLICATION

This is related to the commonly-assigned U.S. patent application, Ser. No. 09/256,853, filed on even date herewith, titled EYELET-BUTTONHOLE SEWING MACHINE (Attorney Docket P/2165-40), the disclosures of which are incorporated by reference herein.

BACKGROUND OF THE INVENTION

The invention relates to an improvement in a sewing machine having a table, driven in one plane and carrying the material to be sewn, a stitch-forming device and a cutting device for producing a buttonhole in the material to be sewn. The buttonhole is provided by an incision, and by zigzag stitches forming a buttonhole bead running around the incision. The incision is produced either before the buttonhole bead in a pre-cutting mode or after the buttonhole bead in a post-cutting mode. The sewing tools comprise a needle bar, which is driven up and down and oscillates in the horizontal direction, and a needle, which is provided at the bottom end of the needle bar and interacts with a rotationally driven looper mounted in the base plate.

An eyelet-buttonhole machine has been sold for many years by the applicant under the designation "Dürkopp Adler Kl. 558". In the pre-cutting mode, the buttonhole is cut first and then the buttonhole bead is produced around the incision. In the pre-cutting mode, the aim is to ensure that opposite seam rows lie exactly next to one another, so that fraying of the cut-open material is prevented. In the post-cutting mode, first the buttonhole bead is produced and then the buttonhole is cut. In the post-cutting mode, an intermediate space (intermediate material) must remain between the two opposite stitch rows forming the buttonhole bead, so that during the subsequent cutting of the buttonhole only the material to be sewn is cut and not the sewn buttonhole bead.

To produce the two different bead positions required in the pre-cutting and post-cutting modes, respectively, both the motion of the needle bar and the motion of the table are controlled in this machine. Both the stitch position affecting the intermediate material and the stitch width can be set on this machine. The table is arranged so as to be longitudinally movable and rotatable or pivotable below the needle. The longitudinal motion is controlled by a main cam plate and the pivoting motion is controlled by an eyelet control disk. The pivoting motion is necessary so that the material can be laterally displaced below the needle in order to thereby produce the eyelet of the buttonhole bead. By selection of a particular eyelet control disk, the pivoting motion of the table is controlled during the forming of the eyelet, so that the width of the eyelet can be varied independently of the forming of the stitches.

The operability and the functional reliability of a machine controlled in such a way are very high. The exchange of the control disks for various buttonhole shapes, however, is time-consuming and therefore costly. In addition, this sewing machine is of very complicated mechanical construction, which results in a large number of different individual parts. The large number of parts requires not only a corresponding cost-intensive assembly effort but also elaborate stockkeeping, as a result of which the manufacturing and spare-parts costs increase.

DE 41 32 586 C2 discloses an eyelet-buttonhole sewing machine in which the intermediate material is provided by displacing the sewing pattern for producing an offset. This offset is imparted to the transport table. That is to say, before the forming of the stitches is started, the transport table is put into such a position that the inner stitch of the needle, provided opposite the subsequent incision point, maintains a corresponding distance from the opposite stitch. To this end, the table is driven by two stepping motors, which are arranged along respective axes (X, Y) disposed perpendicularly to one another. By the storage of different data records which are used to control the stepping motors, the offset can be activated according to operating mode.

A disadvantage with this machine is that two sets of activating data for the X- and Y-motors have to be re-calculated as a function of the desired offset value and the desired dimension of the intermediate material. If steps are lost when approaching the initial position, there is the risk of the stitches being staggered in the pre-cutting mode and of the already-formed buttonhole bead subsequently being cut open as a result.

German Patent 690 654 discloses a buttonhole sewing machine having a main cam plate for controlling the longitudinal motion of the material-supporting plate, on which the material to be sewn lies. The motion of the table for forming the buttonhole eyelet is controlled by an interchangeable auxiliary cam plate mounted outside the housing on a rotatable supporting pin passing through the machine housing. The exchange of the auxiliary cam plate for forming different buttonhole eyelets is quite complicated.

U.S. Pat. No. 1,991,627 discloses a buttonhole sewing machine which is provided with a device for adjusting or changing the position of those stitches of the zigzag stitches which face one another in order to produce the intermediate material within the buttonhole bead which is necessary in the post-cutting mode.

Reference may also be made to German Patent 16 60 845, which discloses a twin-thread chain-stitch buttonhole sewing machine in which the overstitch width is automatically adjustable before the sewing of the crossbar. To this end, a device which uncouples the drive mechanism producing the zigzag motion of the needle from the manual setting and sets it to a predetermined value of the overstitch width is actuated when a certain rotary-angle position of the stitch-pattern tools is reached. A change in the stitch width position by program over the entire stitch width for an eyelet buttonhole is not possible.

The disclosures of all prior art mentioned herein are expressly incorporated by reference.

SUMMARY OF THE INVENTION

In view of these problems, a machine of this type, in which the table is driven via stepping motors, may advantageously be improved in such a way that the data for the activation of the stepping motors of the table can remain unchanged, even when the sewing pattern is changed.

The problem may be solved according to a first embodiment of the invention by a sewing machine having a movably driven table carrying the material to be sewn, sewing tools and a cutting device for producing a buttonhole in the material to be sewn, which buttonhole is provided with an incision, is produced in the pre-cutting or post-cutting mode and is bounded by zigzag stitches, running around the incision, of a buttonhole bead, the sewing tools comprising a needle bar, which is driven up and down and oscillates in the horizontal direction, and a needle, which is provided at the bottom end of the needle bar and interacts with a looper mounted in the base plate, and an adjusting device for changing the position of the zigzag stitches being provided in order to produce the intermediate material in the buttonhole bead in the post-cutting mode, and the oscillating motion of the needle bar being controllable by a selective drive mechanism, the position of the zigzag stitches being changed in direct coupling with the rotary position of the sewing tools by shifting the drive mechanism.

The change in the stitch position in the post-cutting mode is effected as a function of the rotary position of the stitch-forming device. A cam plate is provided for this purpose, and this cam plate has a cam profile corresponding to the width of the desired intermediate material. By the change in the stitch position while maintaining the stitch width, the appearance of the stitch bead is not impaired. Since the intermediate material is guided mechanically, it is impossible for the stitch bead to be cut open in the post-cutting mode if the drive motors for the table lose steps. At worst, the appearance of the seam will be impaired. Furthermore, it is advantageous for the motion for changing the stitch position to be derived from an existing rotary motion, since the bead is thereby also formed in the buttonhole eyelet in an optimum manner. A change in the stitch data is not necessary.

The position of the zigzag stitches is controlled by a cam track. This cam track may be formed on a lobe which rotates together with the adjusting shaft for the sewing tools or it may be attached in a fixed position so that the adjusting shaft for the drive mechanism can run on it.

The change in the position of the zigzag stitches is preferably effected while maintaining their width. This offers the advantage that no further changes are necessary in order to produce the buttonhole bead in the post-cutting mode. The stitch width may of course be reduced if the visual impairment of the buttonhole were to become too great as a result of the intermediate material while the stitch width stays unchanged.

The width of the intermediate material is preferably established by a cam plate arranged on the adjusting shaft for the sewing tools (looper, needle bar or needle).

The drive mechanism is preferably arranged on an arm shaft driving the needle bar and so as to be pivotable about the arm shaft. The cam plate can then be connected to the drive mechanism via an essentially vertically running rod.

According to a second embodiment of the invention, the problem may be solved by a sewing machine having a movably driven table carrying the material to be sewn, sewing tools and a cutting device for producing a buttonhole in the material to be sewn, which buttonhole is provided with an incision, is produced in the pre-cutting or post-cutting mode and is bounded by zigzag stitches, running around the incision, of a buttonhole bead, the sewing tools comprising a needle bar, which is driven up and down and oscillates in the horizontal direction, and a needle, which is provided at the bottom end of the needle bar and interacts with a looper mounted in the base plate, and an adjusting device for changing the position of the zigzag stitches being provided in order to produce the intermediate material in the buttonhole bead in the post-cutting mode, and the oscillating motion of the needle bar being controllable by a selective drive mechanism, the position of the zigzag stitches being changed as a function of the number of executed stitches for the buttonhole by shifting the drive mechanism.

By this design, the actuation of the drive mechanism can be controlled via an actuator, which is preferably designed as a pneumatic cylinder. The multiplicity of parts is thereby reduced. The sewn stitches of the buttonhole bead are counted via a control, and the pneumatic cylinder is activated in accordance with data stored in the control.

It is also taken into account that, for the case in which the position of the zigzag stitches is controlled via a cam track in direct coupling with the rotary position of the sewing tools, there is also an indirect relationship to the number of stitches executed for the buttonhole, since, due to the fixed coupling, the cam track comes into effect after a predetermined number of stitches.

Other features and advantages of the present invention will become apparent from the following description of embodiments of the invention which refers to the accompanying drawings.

BRIEF DESCRIPTION OF THE DRAWINGS

FIG. 1 shows a front view of an eyelet-buttonhole sewing machine;

FIG. 5 shows a sectional view of a bottom part of the sewing machine taken along section line V—V in FIG. 1;

FIG. 13 shows a view of the region shown in FIG. 10, taken in the direction of arrow XIII;

DETAILED DESCRIPTION OF EMBODIMENTS OF THE INVENTION

Figure 2:
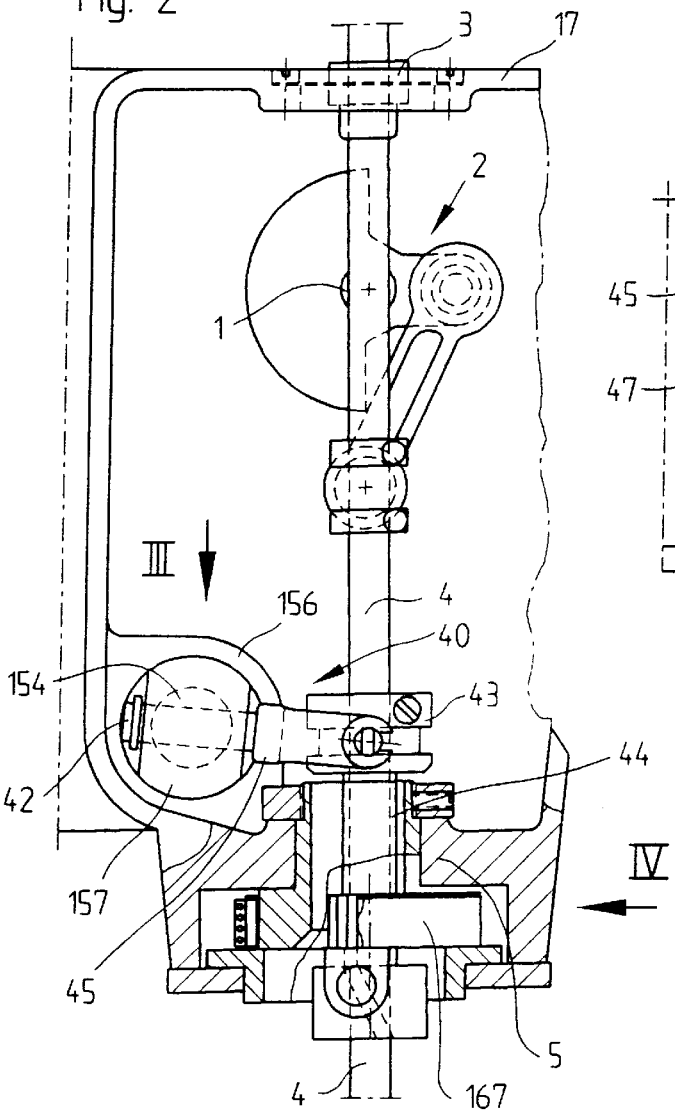
FIG. 2 shows a view of the head of the sewing machine taken in the direction of arrow II of FIG. 1 on an enlarged scale.
Figure 4:
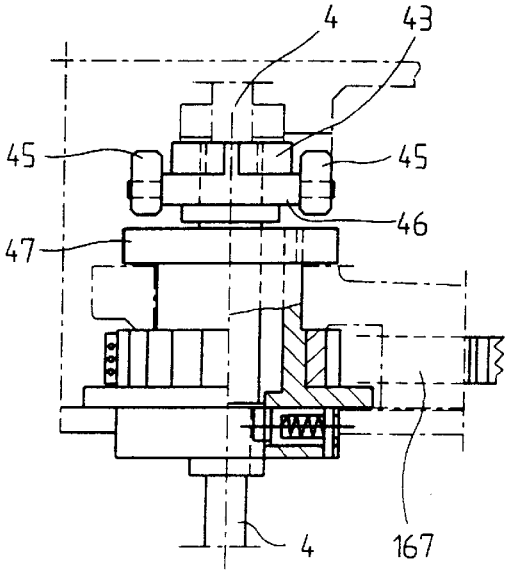
FIG. 4 shows a partial sectional view of the bottom bearing of the needle bar taken in the direction of arrow IV in FIG. 2.

The sewing machine has a housing 17 which is composed of the base plate 12, the column 16 and the arm 22. The arm shaft 1, mounted so as to be rotatable in the arm 22, is driven via a motor 18 and a belt drive, comprising two toothed-belt pulleys 23, 24 and the toothed belt 20. The arm shaft 1 drives the needle bar 4 up and down via a crank drive 2, the needle bar 4 being mounted vertically in the arm 22 in bearings 3, 5. Inserted into the bottom end of the needle bar 4 is the needle 6, which interacts with the looper 11. The connection between the arm shaft 1 and the motor 18 is effected by the belt 20 and the belt pulleys 23, 24.

A looper support 7 including the looper 11 is rotatably mounted in a top bearing 8 and a bottom bearing 10. The rotary position of the looper 11 is effected by the stepping motor 13 and the belts 15, 165. Via the adjusting shaft 162 with the toothed-belt pulleys 163, 164 provided thereon, and the belt 167, the sewing tools, that is the looper 11 and the needle bar 4 with the needle 6, are coupled to one another, so that both components can be rotated in synchronism in order to produce the buttonhole eyelet.

Figure 3:
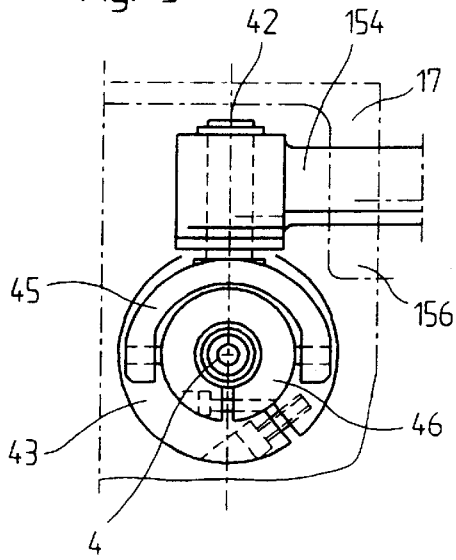
FIG. 3 shows a view of a region of the sewing machine in the direction of arrow III of FIG. 2.
Figure 9:
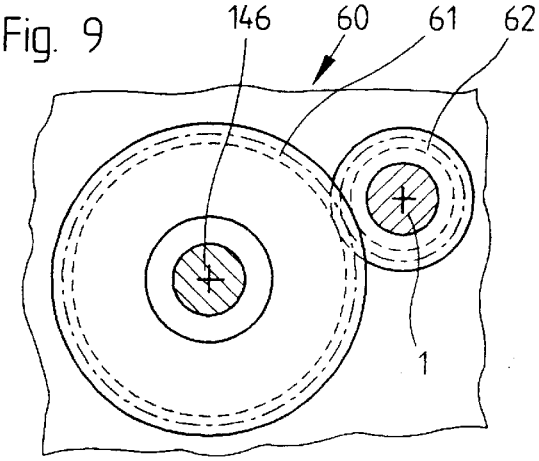
FIG. 9 shows a view taken along section line IX—IX of FIG. 7, the view being rotated counterclockwise through 90°.

The oscillating motion of the needle bar 4 for producing the zigzag stitches, acting in the horizontal direction, is initiated by the zigzag device 40 shown in FIG. 2. The oscillating shaft 154 is mounted in the bearing 156. A forked lever 45 embraces the adjusting ring 43, which is secured to the needle bar 4. The forked lever 45 is provided with a stem 42, which projects in the direction pointing away from the needle bar 4. This stem 42 engages in one end of the oscillating shaft 154 (see FIG. 3). The amplitude of the needle oscillation, that is the stitch width a, can be initiated by changing the pivoting motion of the oscillating shaft 154. Provided for this purpose is an eccentric 145, which is mounted on the shaft 146 and interacts with a frame 143 (see FIG. 8). The frame 143 has two arms 144 and 138. Whereas one arm 138 runs via link blocks 141, 142 in a link 126 provided in the link shaft 109, the other arm 144 is connected via the shoulder pin 151 to the lever 152 fastened to the oscillating shaft 154 via the clamping device 153. The motion of the frame 143 and thus the oscillating motion of the oscillating shaft 154 can be controlled via the eccentric 145.

The mode of operation of an eyelet-buttonhole sewing machine is sufficiently known. In particular, reference is made in this respect to the operating instructions or machinist's instructions for the machine "Dürkopp Adler Kl. 558", the disclosures of which are incorporated by reference.

Figure 10:
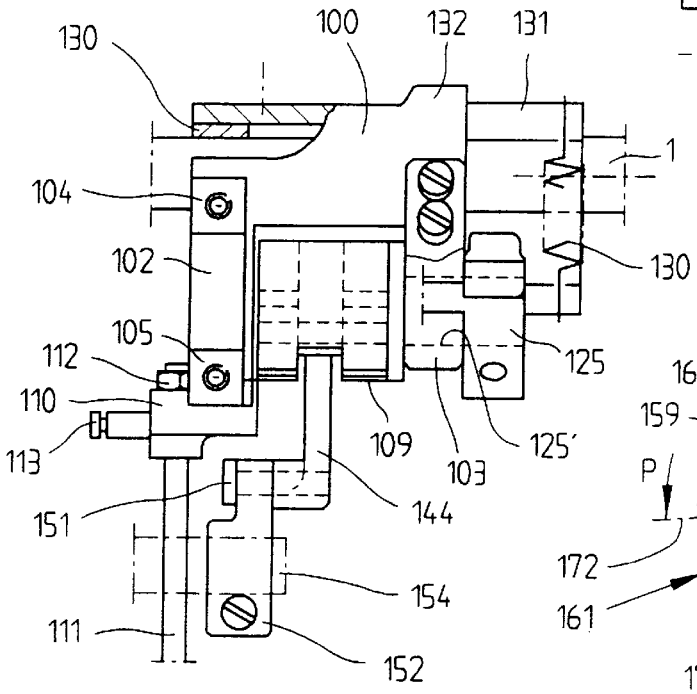
FIG. 10 shows a view of a part of the region shown in FIG. 6 taken in the direction of arrow X.

The drive mechanism for producing the zigzag motion is explained below:

As shown in FIG. 10 and FIG. 13, a U-shaped frame 100 is pivotably mounted on the arm shaft 1 by a bearing 101. The frame 100 has a leg 102 and a leg 103. A top web 104 and a bottom web 105 are formed on the leg 102. A plate 106 is fastened to the webs 104, 105 by means of screws 107. Formed in the web 104 is a bore 108, in which one end of the link shaft 109 is rotatably accommodated. The web 105 has an arm 110, in the end of which a rod 111 is fastened via a thread 99 with a lock nut 112. Furthermore, a pin 113 is provided on the arm 110. Hung on the pin 113 is one end of a preloaded spring 114, the other end of which is hung on a pin 115 attached to the column 16. An extension 116 having an internal thread is arranged on the plate 106, and an adjusting screw 117, which may at times be referred to as an adjusting device, is rotatably accommodated on the extension 116 (see FIG. 6). As shown in FIG. 13, the spring 114 strives to rotate the frame 100 clockwise despite any rotation of the arm shaft 1.

The arm 22 of the sewing machine is formed with a window 118, which is closed by a plate 119 by means of screws. The plate 119 is formed with a bore (not designated in any more detail here) for the passage of the adjusting screw 117. The rotary position of the frame 100 is limited by the contact of the adjusting screw 117 with the plate 119. The pivoting motion of the frame 100 can be blocked by screwing in the adjusting screw 117.

Figure 8:
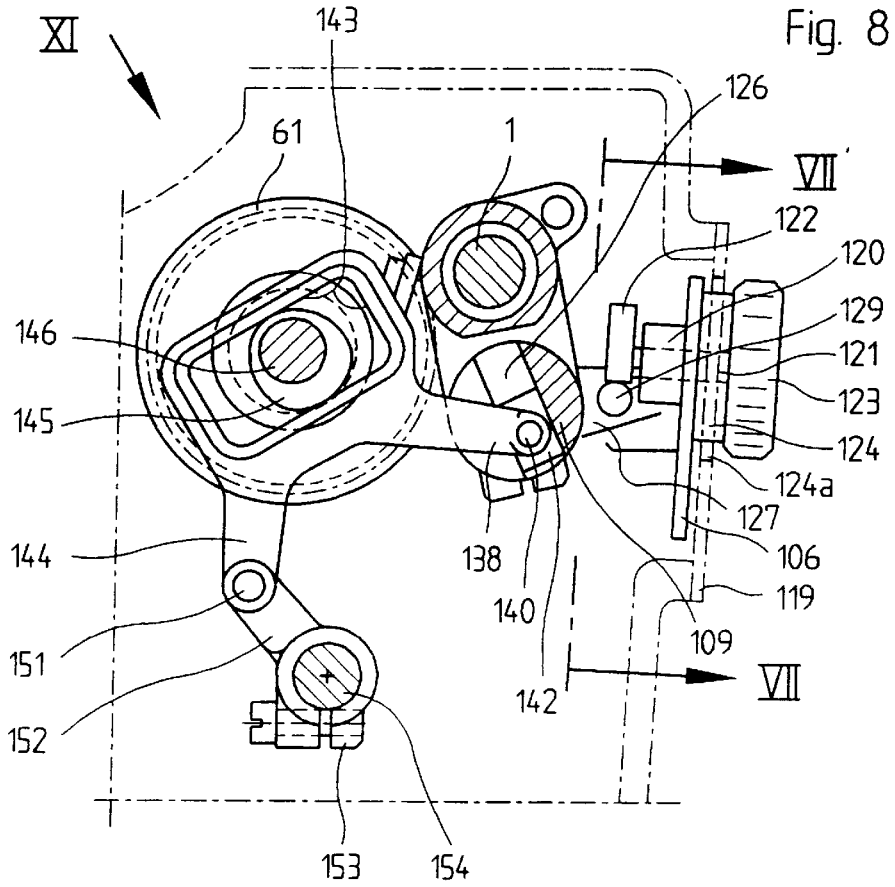
FIG. 8 shows a view taken along section line VIII—VIII of FIG. 7, the view being rotated counterclockwise through 90°.
Figure 12:
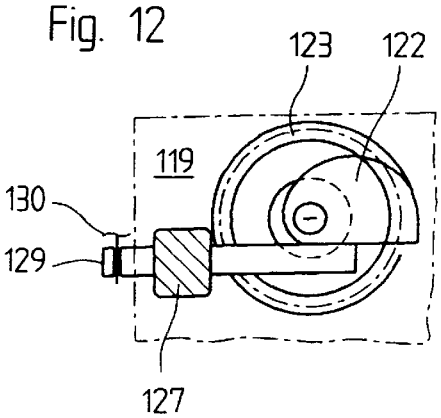
FIG. 12 shows a view taken along line XII—XII of FIG. 8.

As shown in FIG. 8, the plate 106 is formed with a bearing 120, in which a shaft 121 is rotatably mounted. The shaft 121 is firmly connected to a spiral cam plate 122 at one end (FIG. 12) and is provided with an adjusting knob 123 at its free end, the adjusting knob 123 being secured to the shaft 121 by a setscrew (not shown). The adjusting knob 123 is provided with a shoulder 124, which projects with a clearance of about 2 mm through a bore **124*a* provided in the plate 119**.

Figure 6:
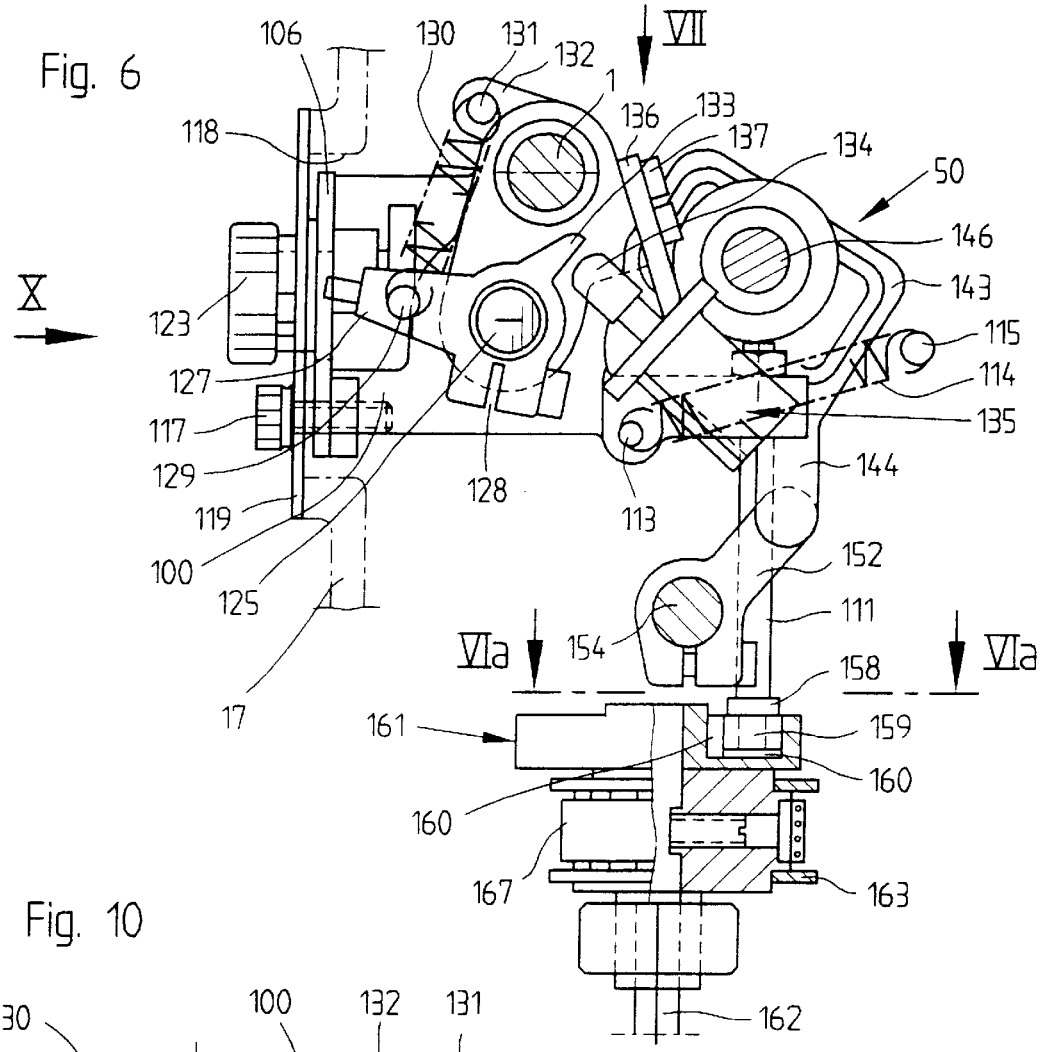
FIG. 6 shows a sectional view taken along section line V—VI in FIG. 1 on an enlarged scale.
Figure 11:
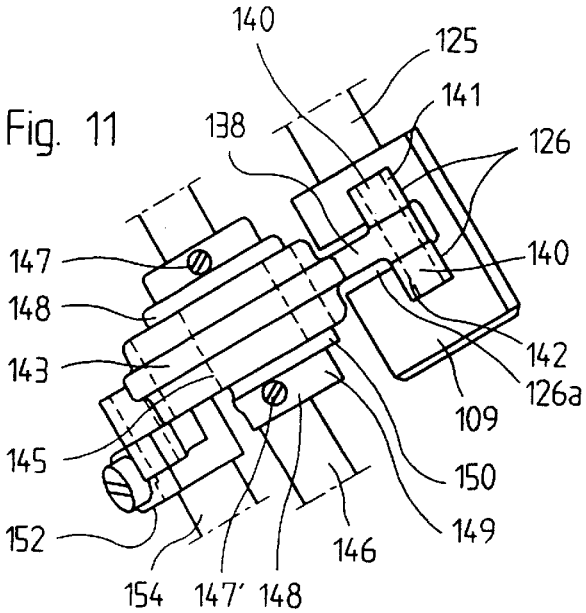
FIG. 11 shows a view of a region shown in FIG. 8, taken in the direction of arrow XI.

As shown in FIG. 11, the link shaft 109 is formed with a stepped shaft 125, which is rotatably accommodated in the bore 125' formed in the leg 103. In addition, the link shaft 109 is formed with a T-shaped recess **126*a*. A lever 127 is secured to the free end of the shaft 125 via a clamping device 128. The lever 127 is formed with the stud 129 (FIG. 6). One end of a preloaded spring 130 is hung on one end of the stud 129. The other end of the spring 130 is hung on a stud 131, which is fastened in a lug 132, which is arranged on the frame 100 in the region on the side of the leg 103. The other end of the stud 129 bears against the cam plate 122 (see FIG. 12). The spring 130 strives to rotate the lever 127 including the shaft 125 connected to it in the clockwise direction of rotation (FIG. 6). Formed on the lever 127 is an extension 133, which is located at a distance from a plunger 134 of a single-acting pneumatic cylinder 135. The pneumatic cylinder is formed with an internal compression spring (not shown here), so that the pneumatic cylinder 135, without the admission of compressed air, assumes a state in which the plunger 134 is in a retracted position. The pneumatic cylinder 135 is formed with a supporting plate 136, which is fastened to the frame 100 in the region of the leg 103 by screws 137. As shown in FIG. 6, the pneumatic cylinder 135 and the lever 127 are arranged in such a way that the plunger 134, when compressed air is admitted to the pneumatic cylinder 135, strikes against the extension 133 of the lever 127, and the shaft 109 clamped to the lever 127 via the journal 125** is thereby rotated counterclockwise, as a result of which the amplitude of the needle-bar oscillation is changed. This change is carried out if a crossbar is to be optionally sewn (not shown) at the end of the buttonhole.

Figure 16:
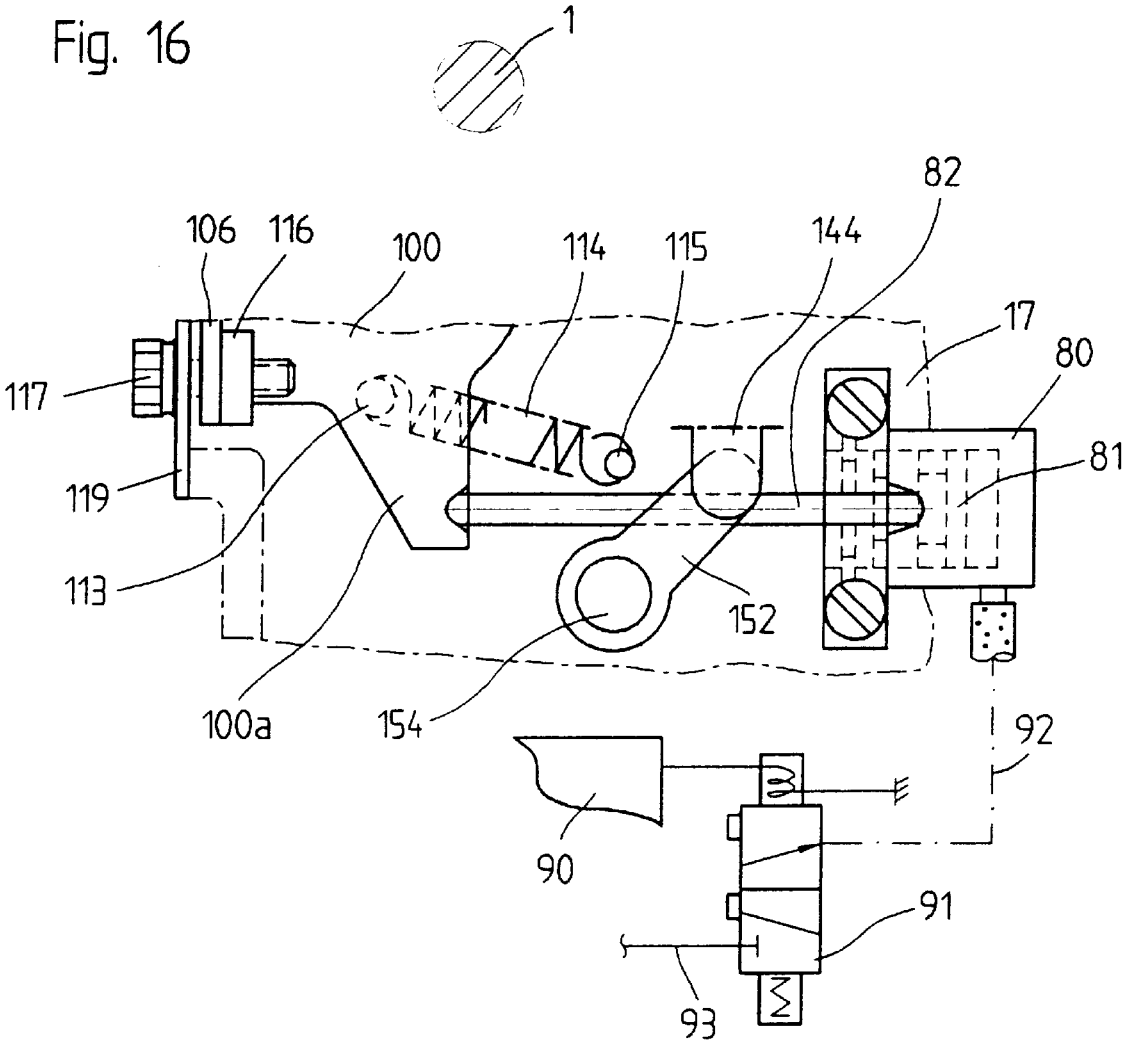
FIG. 16 shows a sectional view analogous to that shown in FIG. 6 of another exemplary embodiment, having a drive mechanism activated via an actuator.

The pneumatic cylinder 135 and a pneumatic cylinder 80 of the further exemplary embodiment (FIG. 16) are connected to a control 90 in such a way that they can be activated.

One end 138 of a frame 143 projects into the T-shaped recess **126*a*, a stud 140 being fastened to this end 138 (FIG. 11). At the side of the end 138, link blocks 141, 142 are rotatably accommodated on the stud 140. The link blocks 141, 142 are dimensioned in such a way that they are displaceably accommodated without play in the parts of the recess 126*a* which surround them. As shown in FIG. 8, an arm 138 and an end 144 are formed on the frame 143. With its longer opposite sides, the frame 143 contains an eccentric 145, which is secured to a shaft 146 by a setscrew 147**.

Furthermore, the eccentric 145 is formed with a collar 148. An adjusting ring 149 having a collar 150 is secured to the shaft 146, likewise by a setscrew 147'. The design of the eccentric 145 having the collar 148 and of the adjusting ring 149 having the collar 150 is such that the frame 143 is guided axially and radially without play (see FIGS. 8 and 11). The end 144 of the frame 143, via a shoulder pin 151, is connected in an articulated manner to the end of a lever 152, the free end of which is formed with a clamping device 153. The latter encloses a shaft 154. As shown in FIG. 1, the shaft 154 is rotatably mounted in the arm 1 of the sewing machine in bearings 155, 156. At its end facing the needle bar 4, the shaft 154 is formed with a part 157 which is wider in diameter.

Referring again to FIG. 6, an extension 158 is provided on the bottom end of the rod 111, this extension 158 being intended to axially guide a roller 159 rotatably accommodated underneath it on the rod 111. The roller 159 is enclosed with clearance by a U-shaped cam track 160, which is formed so as to be continuous in a cam plate 161 according to a predetermined profile. The cam plate 161 is firmly connected to the shaft 162, to which the top toothed-belt pulley 163 and the bottom toothed-belt pulley 164 are likewise fastened.

Figure 6A:
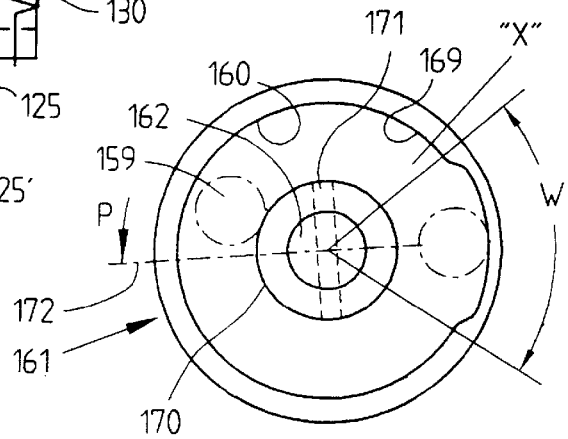
FIG. 6*a* shows a plan view of the cam plate taken along line VIa—VIa in FIG. 6.
Figure 7:
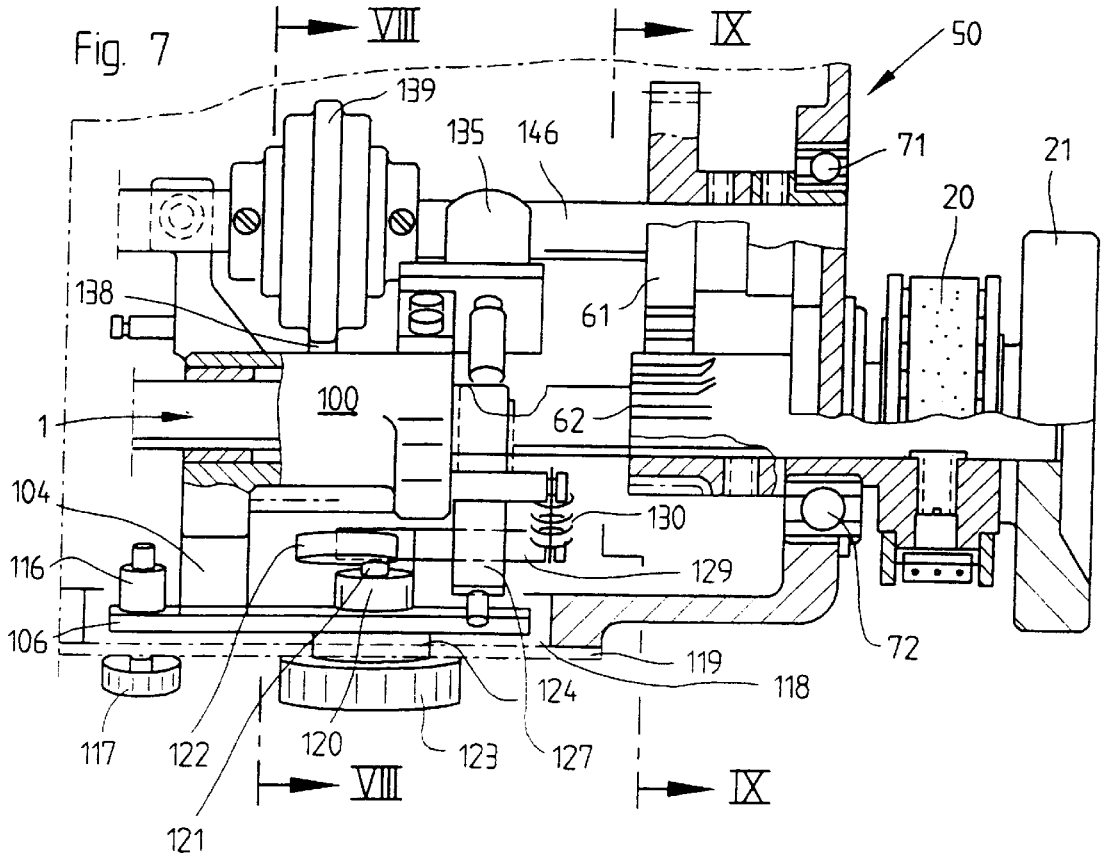
FIG. 7 shows a view of the region shown in FIG. 6, taken in the direction of arrow VII, or a partial view into the open machine arm in the direction of arrow VII' of FIG. 1.

Via the rod 111, which is screwed to the frame 100, the frame 100 is connected to the cam plate 161 fastened above the toothed-belt pulley 163 to the shaft 162. As shown in FIG. 6*a*, the cam track 160 made in the cam plate 161 is defined by an inner, concentric part 170 and by an outer lobe 169. The cam plate 161 is connected to the adjusting shaft 162 in a rotationally locked manner by a pin 171 extending through the part 170 and the adjusting shaft 162. The cam track 160 and the roller 159 accommodated therein are dimensioned in such a way that the roller 159, in one position, can roll on the concentric part 170. In another position, on the other hand, the roller 159 can roll on the lobe 169, so that an evading motion is then imparted to the roller 159 in accordance with the profile of the lobe 169. If the adjusting shaft 162 is rotated by the stepping motor 13 in order to bring the sewing tools into position for the forming of the bead in the eyelet 28' of the buttonhole, the cam plate 161 is also rotated. Provided at the bottom end of the rod 111 is a roller 159, which runs on the lobe 169. A rotation of the cam plate 161 produces a deflection of the rod 111 and thus a pivoting motion of the frame 100. In the position shown in FIG. 6, the slackening of the screw 117 causes the roller 159 to come into contact with the cam track 160, which recedes radially outward, by a pivoting motion of the frame 100 in the counterclockwise direction of rotation, which is effected by the force of the tension spring 114. The shaft 154 is simultaneously displaced as a result, which changes the piercing point of the needle 6 in the material 36 to be sewn and sets the width of the intermediate material b, e (FIGS. 14, 15) in the buttonhole eyelet 28'. Tightening of the screw 117 causes the roller 159 to come into contact with the concentric part 170 of the cam plate 161 and thus causes the frame 100 to pivot against the force of the spring 114 in the clockwise direction of rotation.

Figure 15:
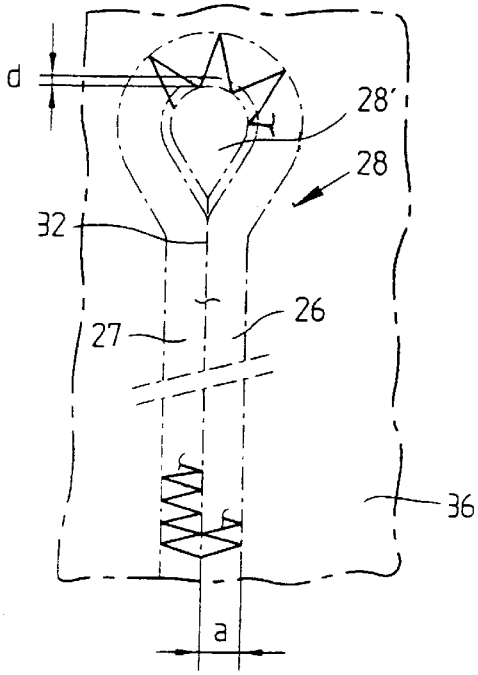
FIG. 15 shows a view on an enlarged scale of an eyelet buttonhole produced in the pre-cutting mode.

The mode of operation of the sewing machine is explained briefly below:

In the pre-cutting mode, a buttonhole bead 28, as shown in FIG. 15, is produced in the material 36 to be sewn, which is fixed to the table 9 by a clip 35. In this mode, the inner piercing points of the needle 6 corresponding to the opposite stitch rows 26, 27 located in the longitudinal region of the buttonhole bead 28 must be adjacent to each other or correspond to one another, so that the incision 32 produced by the cutting device 34 before the sewing does not fray but instead is enclosed by the stitch rows 26, 27. The inner needle position points of the zigzag stitch are displaced toward the interior by the dimension d in the region of the eyelet 28', so that the cut edge of the incision 32 is covered over the entire region of the eyelet buttonhole.

The width a of the zigzag stitch can be preset mechanically. For this purpose, the machine is located in its normal position (no intermediate material). To this end, the frame 100 is in its end position in the clockwise direction of rotation. The frame 100 is pulled into this end position against the force of the spring 114 by tightening the screw 117. The roller 159, which is arranged at the bottom end of the rod 111 and runs in the cam plate 161, bears against the concentric part 170 of the cam plate 161 in this position.

Figure 14:
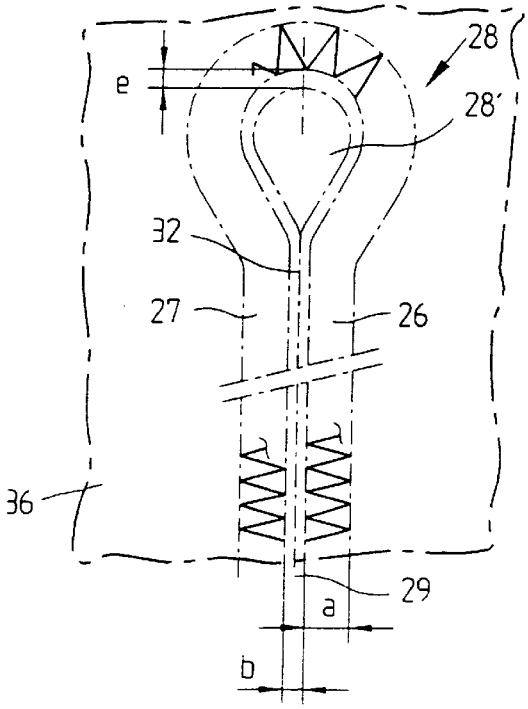
FIG. 14 shows a view on an enlarged scale of an eyelet buttonhole produced in the post-cutting mode.

FIG. 14 shows an eyelet buttonhole produced in the post-cutting mode. Intermediate material 29 of width b must be set between the two opposite stitch rows 26, 27 in the longitudinal region, and this intermediate material 29 enables the incision 32 to be formed after the sewing, without the buttonhole bead 28 being cut open in the process. In the region of the eyelet 28', a distance e between the inner needle piercing points and the incision point is set. Compared with the pre-cutting mode, the stitch width a is constant. The change in the stitch position is effected via the cam plate 161 or the roller 159 arranged at the bottom end of the rod 111. After the adjusting screw 117 is slackened, the frame 100 is pivoted in the counterclockwise direction of rotation by the force of the spring 114. In the process, the rod 111 travels radially outward in the cam plate 116 and comes into contact with the lobe 169. When the roller 159 comes into contact with the profile of the lobe 169 (the cam track 160), a further pivoting motion of the frame 100 is prevented. This displacement of the frame 100 leads to a displacement of the frame 143, which displaces the oscillating shaft 154 via the arm 144 having the lever 152. The displacement of the oscillating shaft 154 sets the width b of the intermediate material 29. Starting from the line of symmetry designated by 172 in FIG. 6*a*, a rotation of the sewing tools is now effected in the direction of arrow P. The stitch row 26 is formed. At the inlet of the eyelet 28', the roller 159 is located at the point identified by "X" in FIG. 6*a*. The rotation of the sewing tools in the eyelet region and the displacement of the needle piercing points by the dimension e at the apex of the eyelet 28' are then effected within the range of the angle W. By the mechanical coupling of the cam plate 161 or the frame 100 to the rotary motion of the looper 11 and the needle bar 4, the change in the stitch position while maintaining the stitch width a is therefore effected over an angle W.

Since the rotation of the cam plate 161 is effected as a function of the degree of completeness of the respective buttonhole, there is an indirect relationship here to the number of stitches already executed for the buttonhole. This is also characteristic of the further exemplary embodiment shown in FIG. 16, which is explained in more detail below:

Instead of a cam plate 161, which is arranged on the shaft 162, a separate actuator 80 formed by a pneumatic cylinder is provided. The pneumatic cylinder 80 is firmly screwed to the housing 17 and its piston 81 interacts with a pressure rod 82, which acts on an arm 100*a* formed on the frame 100. Via the tension spring 114, the frame 100 is held in its end position pivoted in the counterclockwise direction of rotation. The cylinder 80 is connected via the pressure line 92 to a valve 91, which in turn is connected via the compressed-air line 93 to a compressed-air source (not shown here in any more detail). The valve 91 is connected to the electrical control 90. The control 90 counts the completed stitches and thereby detects the degree of completion of the buttonhole. As soon as the stitch position has to be changed, the control 90 transmits a signal to the valve 91, which opens and connects the compressed-air line 93 to the line 92. The piston 81 extends and the pressure rod 82 pivots the lever 100 in the clockwise direction of rotation about the arm shaft 1 (only indicated by broken line in FIG. 16). As a result, the drive mechanism 50 (not shown here in FIG. 16) pivots in a similar manner to the representation shown in FIG. 6 and changes the position of the oscillating shaft 154 via the arm 144 connected to it.

Although the present invention has been described in relation to particular embodiments thereof, many other variations and modifications and other uses will become apparent to those skilled in the art. Therefore, the present invention is not limited by the specific disclosure herein.

What is claimed is:

1. A sewing machine for producing an eyelet buttonhole in a material to be sewn, the buttonhole being provided by an incision in the material and a buttonhole bead comprising zigzag stitches sewn around the incision, the incision being producible either before or after the zigzag stitches, the sewing machine comprising:

a frame;

a needle bar carrying a needle and being mounted on the frame for being driven up and down and rotationally with respect to the frame for sewing said buttonhole bead;

a looper cooperating with said needle, said looper being mounted on said frame and being drivable rotationally with respect to the frame;

a cutting device arranged on said frame for forming said incision in said material;

a zigzag device including a selective drive mechanism on said frame for moving said needle horizontally to a plurality of positions to produce the zigzag stitches; and an adjusting device for adjusting the position of the zigzag stitches produced by the zigzag device, when said incision is to be formed after sewing said buttonhole bead, for leaving intermediate material within said buttonhole bead so that said cutting device can form said incision in said intermediate material without damaging said buttonhole bead;

said selective drive mechanism being directly coupled to said needle bar and said looper for changing the position of the zigzag stitches in response to the rotary position of said needle bar and said looper.

2. The sewing machine as claimed in claim 1, wherein the position of the zigzag stitches is controlled by a cam track coupled to said needle bar and said looper.

3. The sewing machine as claimed in claim 1, wherein the width (b) of the intermediate material is established by a cam plate arranged on an adjusting shaft coupled to said needle and said looper.

4. The sewing machine as claimed in claim 3, wherein the cam plate is connected to the drive mechanism via a substantially vertically running rod.

5. The sewing machine as claimed in claim 1, wherein the drive mechanism is arranged on an arm shaft of the sewing machine and is pivotable about the latter.

6. The sewing machine as claimed in claim 1, wherein the change in the position of the zigzag stitches is effected while maintaining a width (a) thereof.

7. A sewing machine for producing an eyelet buttonhole in a material to be sewn, the buttonhole being provided by an incision in the material and a buttonhole bead comprising zigzag stitches sewn around the incision, the incision being producible either before or after the zigzag stitches, the sewing machine comprising:

a frame;

a needle bar carrying a needle and being mounted on the flame for being driven up and down and rotationally with respect to the frame for sewing said buttonhole bead;

a looper cooperating with said needle, said looper being mounted on said frame and being drivable rotationally with respect to the frame;

a cutting device arranged on said frame for forming said incision in said material;

a zigzag device including a selective drive mechanism on said frame for moving said needle horizontally to a plurality of positions to produce the zigzag stitches;

an adjusting device for adjusting the position of the zigzag stitches produced by the zigzag device, when said incision is to be formed after sewing said buttonhole bead, for leaving intermediate material within said buttonhole bead so that said cutting device can form said incision in said intermediate material without damaging said buttonhole bead; and a control device which controls said selective drive mechanism so as to change the position of the zigzag stitches by adjusting a position of the needle bar in response to a number of stitches which have previously been made.

8. The sewing machine as claimed in claim 7, wherein the drive mechanism comprises an actuator.

9. A sewing machine for producing an eyelet buttonhole in a material to be sewn, the buttonhole being provided by an incision in the material and a buttonhole bead comprising zigzag stitches sewn around the incision, the incision being producible either before or after the zigzag stitches, the sewing machine comprising:

a frame;

a needle bar carrying a needle and being mounted on the frame for being driven up and down and rotationally with respect to the frame for sewing said buttonhole bead;

a looper cooperating with said needle, said looper being mounted on said frame and being drivable rotationally with respect to the frame;

a cutting device arranged on said frame for forming said incision in said material;

a zigzag device including a selective drive mechanism on said frame for moving said needle horizontally to a plurality of positions to produce the zigzag stitches;

an adjusting device for adjusting the position of the zigzag stitches produced by the zigzag device, when said incision is to be formed after sewing said buttonhole bead, for leaving intermediate material within said buttonhole bead so that said cutting device can form said incision in said intermediate material without damaging said buttonhole bead; and a control device which controls said selective drive mechanism so as to change the position of the zigzag stitches in response to a number of stitches which have previously been made;

wherein the drive mechanism comprises an actuator; and wherein the actuator is a pneumatic cylinder.

10. The sewing machine as claimed in claim 9, wherein the drive mechanism is arranged on an arm shaft of the sewing machine and is pivotable about the latter.

11. The sewing machine as claimed in claim 9, wherein the change in the position of the zigzag stitches is effected while maintaining a width (a) thereof.

12. A sewing machine for producing an eyelet buttonhole in a material to be sewn, the buttonhole being provided by an incision in the material and a buttonhole bead comprising zigzag stitches sewn around the incision, the incision being producible either before or after the zigzag stitches, the sewing machine comprising:

a frame;

a needle bar carrying a needle and being mounted on the frame for being driven up and down and rotationally with respect to the frame for sewing said buttonhole bead;

a looper cooperating with said needle, said looper being mounted on said frame and being drivable rotationally with respect to the frame;

a cutting device arranged on said frame for forming said incision in said material;

a zigzag device including a selective drive mechanism on said frame for moving said needle horizontally to a plurality of positions to produce the zigzag stitches;

an adjusting device for adjusting the position of the zigzag stitches produced by the zigzag device, when said incision is to be formed after sewing said buttonhole bead, for leaving intermediate material within said buttonhole bead so that said cutting device can form said incision in said intermediate material without damaging said buttonhole bead; and a control device which controls said selective drive mechanism so as to change the position of the zigzag stitches by adjusting the position of the needle bar in response to a degree of completeness of said buttonhole.

13. The sewing machine as claimed in claim 12, wherein the drive mechanism comprises an actuator.

14. A sewing machine for producing an eyelet buttonhole in a material to be sewn, the buttonhole being provided by an incision in the material and a buttonhole bead comprising zigzag stitches sewn around the incision, the incision being producible either before or after the zigzag stitches, the sewing machine comprising:

a frame;

a needle bar carrying a needle and being mounted on the frame for being driven up and down and rotationally with respect to the frame for sewing said buttonhole bead;

a looper cooperating with said needle, said looper being mounted on said frame and being drivable rotationally with respect to the frame;

a cutting device arranged on said frame for forming said incision in said material;

a zigzag device including a selective drive mechanism on said frame for moving said needle horizontally to a plurality of positions to produce the zigzag stitches;

an adjusting device for adjusting the position of the zigzag stitches produced by the zigzag device, when said incision is to be formed after sewing said buttonhole bead, for leaving intermediate material within said buttonhole bead so that said cutting device can form said incision in said intermediate material without damaging said buttonhole bead; and a control device which controls said selective drive mechanism so as to change the position of the zigzag stitches in response to a degree of completeness of said buttonhole;

wherein the drive mechanism comprises an actuator; and wherein the actuator is a pneumatic cylinder.

15. The sewing machine as claimed in claim 14, wherein the drive mechanism is arranged on an arm shaft of the sewing machine and is pivotable about the latter.

16. The sewing machine as claimed in claim 14, wherein the change in the position of the zigzag stitches is effected while maintaining a width (a) thereof.

17. The sewing machine as claimed in claim 9, wherein said control device changes the position of the zigzag stitches by adjusting a position of the needle bar.

18. The sewing machine as claimed in claim 10, wherein said control device changes the position of the zigzag stitches by adjusting a position of the needle bar.

19. The sewing machine as claimed in claim 11, wherein said control device changes the position of the zigzag stitches by adjusting a position of the needle bar.

20. The sewing machine as claimed in claim 14, wherein said control device changes the position of the zigzag stitches by adjusting a position of the needle bar.

21. The sewing machine as claimed in claim 15, wherein said control device changes the position of the zigzag stitches by adjusting a position of the needle bar.

22. The sewing machine as claimed in claim 16, wherein said control device changes the position of the zigzag stitches by adjusting a position of the needle bar.

* * * * *